United States Patent [19]

Sasaki et al.

[11] Patent Number: 4,975,360

[45] Date of Patent: Dec. 4, 1990

[54] SILVER HALIDE PHOTOGRAPHIC LIGHT SENSITIVE MATERIAL

[75] Inventors: Masao Sasaki; Kaoru Onodera, both of Odawara, Japan

[73] Assignee: Konica Corporation, Tokyo, Japan

[21] Appl. No.: 377,771

[22] Filed: Jul. 7, 1989

Related U.S. Application Data

[63] Continuation of Ser. No. 40,566, Apr. 17, 1987, abandoned.

[30] Foreign Application Priority Data

Apr. 24, 1986 [JP] Japan ..... 61-95022

[51] Int. Cl.[5] ..... G03C 1/30

[52] U.S. Cl. ..... 430/512; 430/622

[58] Field of Search ..... 430/512, 622

[56] References Cited

U.S. PATENT DOCUMENTS

| | | | |
|---|---|---|---|
| 2,994,611 | 8/1961 | Heyna et al. | 430/622 |
| 3,533,794 | 10/1970 | Ohi et al. | 430/512 |
| 4,088,495 | 5/1978 | Habu et al. . | |
| 4,518,686 | 5/1985 | Sasaki et al. | 430/512 |
| 4,607,004 | 8/1986 | Ikenoue et al. | 430/622 |

FOREIGN PATENT DOCUMENTS

| | | |
|---|---|---|
| 0080905 | 12/1982 | European Pat. Off. . |
| 2151098 | 10/1971 | Fed. Rep. of Germany . |
| 3408329 | 7/1984 | Fed. Rep. of Germany . |
| 1287770 | 12/1969 | United Kingdom . |

OTHER PUBLICATIONS

Patent Abstract of Japan, vol. 8, No. 129 (P-280) [1566], dated Jun. 15, 1984.

Patent Abstract of Japan, vol. 10, No. 212 (P-480) [2268], dated Jul. 24, 1986.

*Primary Examiner*—Paul R. Michl

*Assistant Examiner*—Mark R. Buscher

*Attorney, Agent, or Firm*—Jordan B. Bierman

[57] ABSTRACT

A silver halide photographic light-sensitive material comprising a support provided thereon with photographic layers including at least one silver halide emulsion layer and at least one non-light-sensitive layer is disclosed. The silver halide emulsion layer comprises silver halide grains comprising not less than 80 mol % of silver chloride. At least one of the photographic layers contains an ultraviolet absorbing agent which is in the liquid state at ordinary temperature. And at least one of the photographic layers is hardened with a vinylsulfon hardner. The photographic material has a high developing rate and a high antipressure property, so it is suitable for a rapid processing.

12 Claims, No Drawings

SILVER HALIDE PHOTOGRAPHIC LIGHT SENSITIVE MATERIAL

This is a continuation of Ser. No. 040,566, filed 4-17-87, now abandoned.

FIELD OF THE INVENTION

The invention relates to a silver halide photographic light-sensitive material, in particular to a silver halide photographic light-sensitive material being excellent in the rapid processing properties.

BACKGROUND OF THE INVENTION With a silver halid color photographic light-sensitive material, a dye-image is usually formed in such a manner that the color photographic material imagewise exposed is developed in a color developer to react the dye-image forming coupler with the oxidized product of p-phenylenediamine color developing agent. For this process, the color reproduction using the subtractive color process is usually applied. In correspondene with red, green and blue, the cyan-, magenta- and yellow-dye-images are formed respectively in a corresponding light-sensitive layer. In the recent photographic art, the high-temperature developing process and the simplified photographic process are commonly used in order to reduce the time required for the developing process to form the dye-image, mentioned above. To reduce the time for developing in the high-temperature developing process, the increase in developing speed in the course of color development is especially important.

The developing speed of color development greatly depends on both the silver halide photographic light-sensitive material and the color developer.

With the silver halide photographic light-sensitive material, the configuration, size and composition of silver halide grains contained in silver halide emulsion layer greatly influence the developing speed. With the color developer, it is known that the speed is greatly influenced by the conditions of color developer, especially the developing inhibitor in the developer, and pH, temperature and the like of the developer itself. Silver chloride grains, especially, show a significantly high developing speed as described in Japanese Patent Publication Open to Public Inspection (hereinafter referred to as Japanese Patent O.P.I. Publication) No. 232342/1984, and are known to be advantageous in shortening the developing process.

However, the studies by the inventors have revealed that, though a silver halide emulsion comprising certain type of high percentage of silver chloride particles apparently shows a high developing speed, its anti-pressure desensitizing properties are disadvantageously degraded.

At the same time, as a result of the rapid processing, for example, due to the increased transporting speed in an automatic developing machine, the frequencies for sensitization and desensitization caused by scratching or pressuring at various areas within and outside an automatic developing machine have increased. Accordingly, the more excellent anti-pressure properties are required of a light-sensitive material.

Various studies indicate that these mechanical pressures cause silver halide emulsion, which is a constituent of a light-sensitive material, to develop a fogging or desensitization.

For example, the Journal of Photographic Science, by D. Dautrich, F. Granzer, E. Moisar et al., Vol. 21 (1973), pp 221–226, discusses in great detail the strain and lattice defect of silver halide crystals in the case the silver halide grains are deformed due to pressure, and the effect where the similar strain and lattice defect exert on the distribution of latent image centers.

As a means for improving such pressure-fogging and pressuredesensitization, a method to prevent the pressure from reaching the silver halide grains is conventionally known. In this method, various gelatins, polymers or other organic substances are incorporated into a protective layer, intermediate layer, and other layers of light-sensitive material containing silver halide grains.

The examples of the substances used in such a method include the following: heterocyclic compounds described in British Patent No. 738,618; alkylphthalates described in British Patent No. 738,637; alkyl esters described in British Patent No. 738,639; hydrophilic compounds, especially, polyhydric alcohols described in U.S. Pat. No. 2,960, 404; carboxylalkylcelluloses described in U.S. Pat. No. 3,121,060; paraffins and carboxylates described in Japanese Patent O.P.I. Publication No. 5017/1974; glycerin derivatives, and ether and thioether compounds described in Japanese Patent O.P.I. Publication No. 141623/1976; organic high boiling compounds, not mixing with hydrophilic binders, described in Japanese Patent 0.P.I Publication No. 85421/1978; alkyl acrylates and organic acids described in Japanese Patent Examined Publication No. 28086/1978; and others.

However, as a matter of fact, these methods are insufficient in achieving their principal purposes as their preventive effects against intense pressure on a light-sensitive material is virtually non-existant, furthermore, they sometimes give excessive stickiness on the surface of the similar material, or, in terms of the properties of the material, give adverse effects such as sensitization, desensitization, change in gradation, fogging and the like.

Additionally, into photographic emulsion layers and other hydrophilic colloid layers of silver halide photographic light-sensitive material is usually incorporated a hardener in order to enhance the layer hardness by crosslinking binder molecules together It has been also learned that the nature of the above-mentioned anti-pressure properties is influenced by a type of hardener For example, a combination involving a certain silver halide emulsion and a vinylsulfon hardener provided rather good properties. However, some hardeners show different behaviors in accordance with a silver halide emulsion used together, and have limited range of application, or have insufficient gloss of the surface of the photographic material Furthermore, the achieved improvement of anti-pressure properties of such hardeners is quite limited and unsatisfactory.

As can be understood from the description, above, it is the present situation that the silver halide photographic light-sensitive material provided with the photographic properties including the anti-pressure properties in compliance with the rapid processing has not yet been found, and that there is a mounting demand for the improvement of the similar material.

SUMMARY OF THE INVENTION

The first object of the present invention is to provide a silver halide photographic light-sensitive material which has a satisfactory photographic performance even in the rapid processing.

The second object of the invention is to provide the silver halide photographic light-sensitive material which is endowed with satisfactory rapid processing properties by attaining both a high developing speed and excellent anti-pressure properties.

The third object of the invention is to provide the silver halide photographic light-sensitive material which has endowed with preferable physical properties even in the rapid processing.

The above objects of the present invention are acheived by a silver halide photographic light-sensitive material comprising a support provided thereon with photographic layers including at least one silver halide emulsion layer and at least one non-light-sensitive layer, wherein the silver halide emulsion layer comprises silver halide grains comprising not less than 80 mol% of silver chloride, and at least one layer of the photographic layers contains a ultra-violet absorbing agent being in the state of liquid at ordinary temperature, and at least one layer of the photographic layers is hardened with a vinylsulfon hardener.

DETAILED DESCRIPTION OF THE INVENTION

According to the present invention, at least one of silver halide emulsion layers contains silver halide grains comprising more than 80 mol% of silver chloride content. The preferred silver halide grains are those comprising more than 90 mol% of silver chloride content. The content of silver iodide is less than one mol%, or preferably less than 0.5 mol%. More favorably, such silver halide grains are the silver chloro-bromide particles comprising less than 10 mol% of silver bromide content, or silver chloride particles.

The silver halide grains according to the invention may be singly used, or may be combinedly used with other silver halide grains having different composition. Or, the silimar silver halide grains may be used by mixing with silver halide grains containing less than 80 mol% of silver chloride content.

Additionally, silver halide grains containing more than 80 mol% of silver chloride content comprise at least 50 weight %, or preferably at least 75 weight % of the total silver halide grains contained in a silver halide emulsion layer comprising silver halide grains whose silver chloride content is more than 80 mol%.

The composition of the silver halide grains of the invention may be uniform from the interior to the exterior of each particle, or the composition of grains interior may be different from that of grains exterior. Additionally, if the composition of particle interior is different from that of particle exterior, the composition, as a whole, may vary either continuously or discontinuously.

There is no limitation on the grain diamter of silver halide grains of the invention. However, considering the rapid processing properties, sensitivity and other photographic properties, the diameter is favorably within the range of 0.2 to 1.6 μm, or more favorably within the range of 0.25 to 1.2 μm. The grain diameter can be measured by various methods commonly used in the photographc art. The typical measuring methods are described in "Particle Size Analysis" by R. P. Loveland, Proceedings of A.S.T.M. Symposium on Light Microscopy, 1955, pp 94–122, or "The Theory of the Photographic Process" by Mees and James, third edition, published from McMillan & Company (1966), Chapter 2. The grain diameter can be measured by using the projected area of a particle or approximate value of its diameter. If each particle has substantially identical configuration, the particle diameter distribution can be expressed with comparative accuracy by the diameter or projected area.

The diameter distribution of silver halide grains of the invention may be whichever of polydisperse or monodisperse. The similar silver halide grains are, in terms of the diameter distribution, monodisperse silver halide grains having the coefficient of variation favorably less than 0.22, or more favorably less than 0.15. Where, the coefficient of variation means a coefficeint indicating the range of the diameter distribution and can be defined by the following expressions.

$$\text{Coefficient of variation } (S/\bar{r}) = \frac{\text{Standard deviation of grain diameter distribution}}{\text{Mean grain diameter}}$$

Standard deviation of grain diameter distribution ($S$) =

$$\sqrt{\frac{\Sigma(\bar{r} - ri)^2 ni}{\Sigma ni}}$$

$$\text{Mean grain diameter } (\bar{r}) = \frac{\Sigma niri}{\Sigma ni}$$

Where, ri represents the diameter of each grain, ni represents the number of grains. The term "grain diameter" means the grain diameter if each silver halide grain is of spherical type, or the diamter obtained by converting the projected image of cubic or nonspherical grain into the disc image having the same area.

As the configuration of each of silver halide grains of the invention, an optional arbitrary form can be used. One preferred example is a cube having a (100) face as a crystal surface. Also, U.S. Pat. Nos. 4,183,756 and 4,225,666, Japanese Patent O.P.I. Publication No. 26589/1980, Japanese Patent Examined Publication No. 42737/1980 and others, and in the literatures such as the Journal of Photographic Science, 21, 39 (1973) and others, the grains having configurations such as octahedron, tetradecahedron, dodecahedron and the like can be formed and used. Furthermore, the grains having a twin plane can be also used.

For the silver halide grains of the invention, the grains having an identical configuration may be used, or the grains having various configurations mixed may be used.

The silver halide grains of the invention may be obtained through whichever an acid process, neutral process or ammonium process. The grains may be allowd to grow at once or may be allowed to grow after forming seed grains. The two methods to form seed grains and to grow grains may be whichever identical to or differernt from each other.

Additionally, as a method to react soluble silver salt with soluble halide salt, the normal precipitation method, reverse precipitation method or double-jet precipitation method, or the combination of these methods may be arbitrarily used. Among these methods, the double-jet precipitation method is advantageous. Furthermore, pAg-controlled double-jet method which is one example of the double-jet precipitation methods, can be used for this purpose.

If necessary, a solvent for silver halide such as thioether and the like, or a crystal habit controlling agent such as mercapto-groupcontaining compound or a sensitizing dye may be also used.

With the silver halide grains of the invention, while the grains are being formed and/or grown, the interior and/or surface of each grain is allowed to contain metallic ions, by employing a cadmium salt, cadmium salt, zinc salt, lead salt, thallium salt, iridium salt or complex salt, rhodium salt or complex salt, iron salt or complex salt, and, the interior and/or surface of each grain may be endowed with reducing sensitization cores by placing the grains under an adequate reducing atmosphere.

The silver halide grains of the invention may be the grains wherein a latent image is principally formed whichever on the surface thereof or in the interior thereof. However, the grains a latent image is principally formed on the surface are preferable.

Unnecessary soluble salts may be whichever removed from or remained in the silver halide emulsion containing silver halide grains of the invention (hereinafter called the silver halide emulsion of the invention) after the silver halide grains have satisfactorily grown. If the salts are removed, the removal can be performed by following the method mentioned in Research Disclosure No.17643.

The silver halide emulsions of the invention may be chemically sensitized in an ordinary process, namely, a sulfur sensitization process using a sulfur-containing compound or an active gelatin each capable of reacting with silver ions, a selenium sensitization process using a selenium compound, a reduction-sensitization process using a reducing substance, a noble metal sensitization process using a gold or other noble metal compound and so forth can be used independently on in combination.

A silver halide emulsion of the invention can be spectrally sensitized to the desirable wavelength range by employing a dye known as a sensitizing dye in the photographic art. The sensitizing dyes may be whichever independently or combinedly employed. The emulsion may allowed to contain, in addition to a sensitizing dye, a supersensitizer which is a dye not having a light-sensitization capability or a compound not actually absorbing visible radiation, though serving to enhance a sensitization effect of the sensitization dye.

Into a silver halide emulsion of the invention may be added a compound, known as an anti-fogging agent or a stablizer in the photographic art, during and/or at the completion of the chemical ripening of the emulsion and/or after the chemical ripening before the coating of a silver halide emulsion, in order to prevent the fogging of the light sensitive material during the preparation, storage and photographic treatment of the similar material.

The vinylsulfon hardeners preferably usable in the invention is represented by the following Formula [V-I]. Formula [V-I]

$$B-[A_m-D_1-SO_2-CH=CH_2]n$$

wherein B is an orgnanic group such as an alkane residue, an alkene residue, an aryl residue or a heterocyclic residue such as an s-triazine residue, A is a divalent linking group such as —CO— group, —NHCO— group, —CONH— group, —$NHSO_2$— group or —$SO_2NH$— group, D is an alkylene group, an arylene group or an alkenylene group, n is an integer 2 to 6, m is an integer 0 and 1 and 1 is an integer 0 or 1, when n is 2, B is allowed to be a simple link.

The vinylsulfon hardeners usable in the invention include the following: aromatic compounds described in West German Patent No. 1,100,942; alkyl compounds bonded with a hetero atom, described in Japanese Patent Examined Publications No. 29622/1969 and No. 25373 1972; sulfonamide ester compounds described in Japanese Patent Examined Publication No. 8736/1972; 1,3,5-tris[β-(vinylsulfonyl)propionyl]-hexahydro-s-triazines described in Japanese Patent O.P.I. Publication No. 24435/1974; alkyl compounds described in Japanese Patent O.P.I. Publication No. 44164/1976; and others.

Vinylsulfon Hardeners

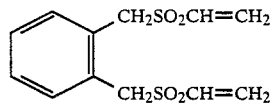

V-1

$O(CH_2CH_2SO_2CH=CH_2)_2$ V-2

$NH(CH_2CH_2SO_2CH=CH_2)_2$ V-3

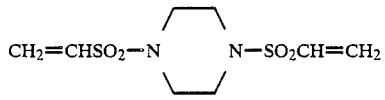

V-4

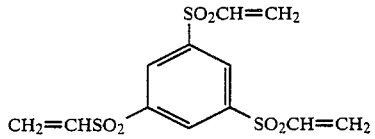

V-5

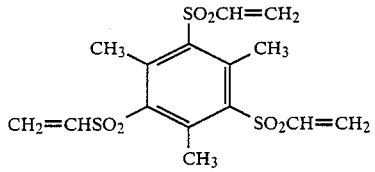

V-6

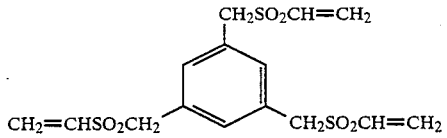

V-7

$CH_3C(CH_2OCH_2SO_2CH=CH_2)_3$ V-8

$C(CH_2OCH_2SO_2CH=CH_2)_4$ V-9

$N(CH_2CH_2OCH_2SO_2CH=CH_2)_3$ V-10

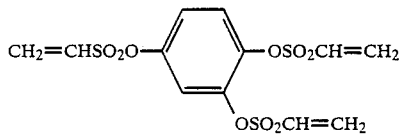

V-11

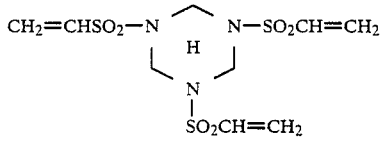

V-12

$C_2H_5C(CH_2SO_2CH=CH_2)_3$ V-13

$C_8H_{17}C(CH_2SO_2CH=CH_2)_3$ V-14

-continued $$CH_2{=}CHSO_2CH_2CH(SO_2CH{=}CH_2)CH_2SO_2CH{=}CH_2 \quad \text{V-15}$$

$$(CH_2{=}CHSO_2CH_2)_3CCH_2Br \quad \text{V-16}$$

$$(CH_2{=}CHSO_2CH_2)_2CHCH(CH_2SO_2CH{=}CH_2)_2 \quad \text{V-17}$$

$$(CH_2{=}CHSO_2CH_2)_3CCH_2OCH_2C(CH_2SO_2CH{=}CH_2)_3 \quad \text{V-18}$$

$$C(CH_2SO_2CH{=}CH_2)_4 \quad \text{V-19}$$

V-20

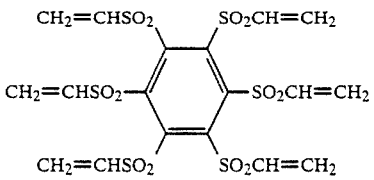

$$(CH_2{=}CHSO_2CH_2)_3CCH_2SO_2CH_2CH_2Cl \quad \text{V-21}$$

V-22

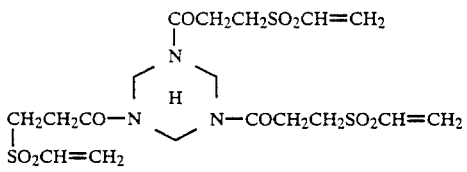

Other than the above-mentioned example compounds, the vinylsulfon hardeners usable in the invention include the reaction products obtained by allowing a compound, which has at least three vinylsulfon groups within its molecular structure and is typified by any of the example compounds [V-5]-[V-22], to react with another compound, which has not only a group to be capable of reacting with a vinylsulfon group but a water-soluble group, such as, for example, diethanolamine, thioglycolic acid, sodium salt of sarcosine and potassium salt of taurine.

Any of these vinylsulfon hardeners is added at the rate of 0.5-100 mg, or preferably 2.0-50 mg per g of gelatin contained in the photographic layers. The method for addition may be either batch method or in-line method.

According to the invention, the vinylsulfon hardener can be added into one or more layers selected from a group comprising silver halide emulsion layers of the invention and non-light-sensitive layers.

The ultraviolet absorbing agent of the invention, which is in the liquid state at an ordinary- temperature may have any chemical structure. However, because of its stability, a 2-(2'hydroxyphenyl)benzotriazole derivative is preferably used.

The expression, "in the liquid state at an ordinary temperature", means the compound is preferably in the liquid state especially at 15 ° C.

The 2-(2'-hydroxyphenyl)benzotriazole derivative preferably used in the invenition is expressed by the following formula [I].

Formula (I)

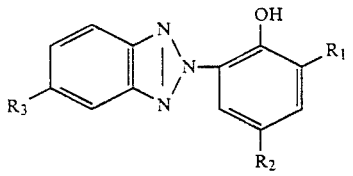

The liquid ultraviolet absorbing agent preferably used in the invention is the 2-(2'-hydroxyphenyl)benzotriazole having substituents represented by $R_1$, $R_2$ or, if required, $R_3$.

The examples of such substituents represented by $R_1$ or $R_2$ include an alkyl group, aryl group, alkoxy group, aryloxy group and others.

The examples which is represented by $R_3$ include a hydrogen atom, halogen atom, alkyl group, aryl group, alkoxy group, aryloxy group, alkenyl group, nitro group, hydroxy group and the like.

Among the ultraviolet absorbing agents expressed by the formula [I], the compounds expressed by any of the following formulas [II], [III], [IV] and [V] are preferably used.

Formula [II]

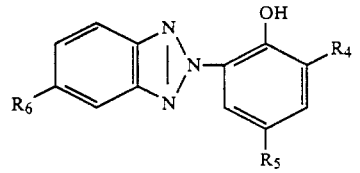

In this formula, $R_4$ represents a methyl group, ethyl group or propyl group. $R_5$ represents a secondary alkyl group having more than four carbon atoms. $R_6$ represents a hydrogen atom or halogen atom, or an alkyl group or alkoxy group having 1 to 8 carbon atoms.

Formula [III]

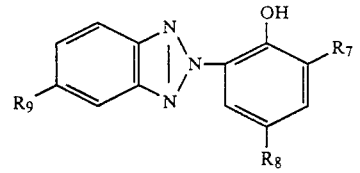

In this formula, $R_7$, $R_8$ and $R_9$ independently represent an alkyl group having more than four carbon atoms. At least one of the alkyl groups expressed by $R_7$, $R_8$ and $R_9$ is a secondary alkyl group.

Formula [IV]

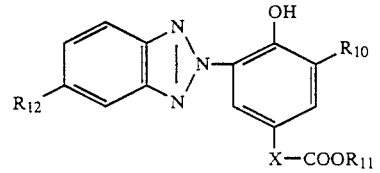

In this formula, $R_{10}$ represents an alkyl group having one to eight carbon atoms. X represents an alkylene group having one to six carbon atoms. $R_{11}$ rerpresents an alkyl group having one to 12 carbon atoms. $R_{12}$ represents the same group as $R_6$.

Formula [V]

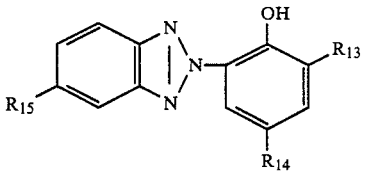

In this formula, $R_{13}$ and $R_{14}$ independently represent a secondary alkyl group having more than four carbon atoms. R15 represents the same group as $R_{16}$.

Next, the typical examples of 2-(2'-hydroxyphenyl)-benzotriazole ultraviolet absorbing agent which is in liquid state at an ordinary temperature are as follows. Naturally, the scope of the invention is not limited only to these examples.

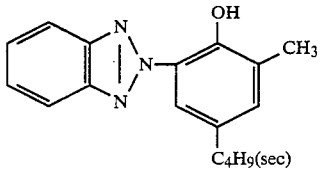

UV-1L

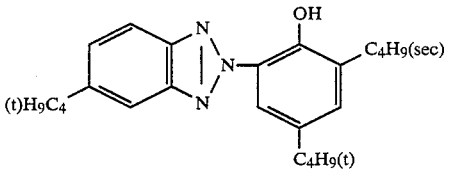

UV-2L

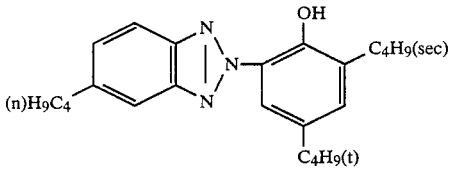

UV-3L

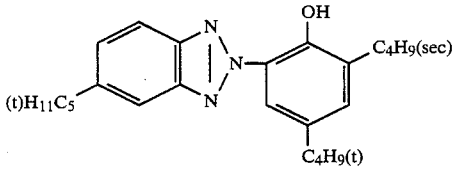

UV-4L

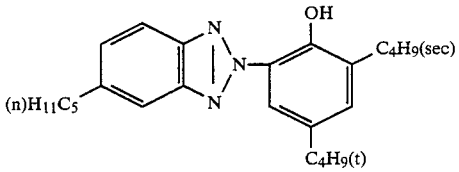

UV-5L

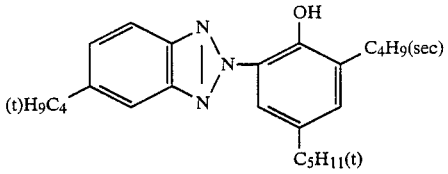

UV-6L

-continued

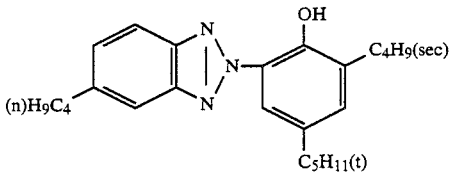

UV-7L

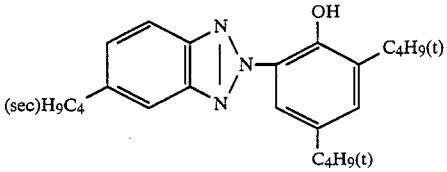

UV-8L

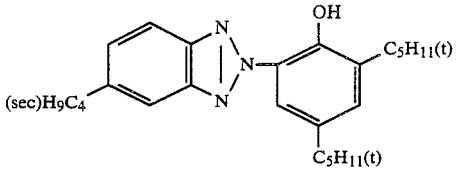

UV-9L

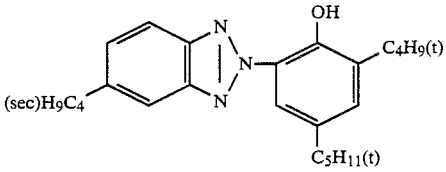

UV-10L

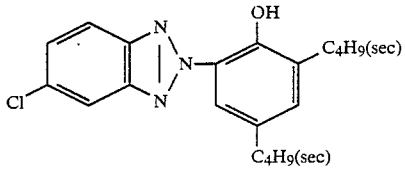

UV-11L

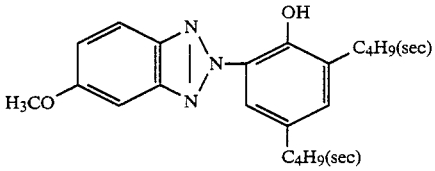

UV-12L

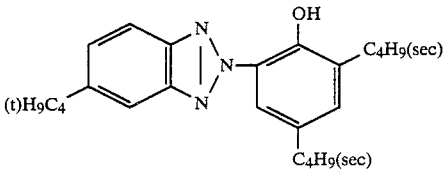

UV-13L

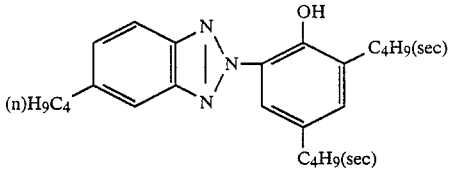

UV-14L

-continued

UV-15L

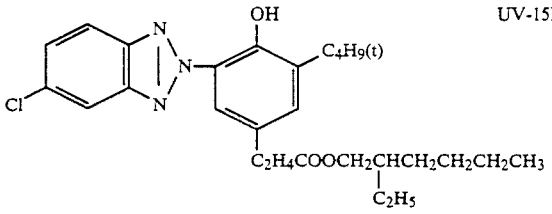

These liquid 2-(2'-hydroxyphenyl)benzotriazole ultraviolet absorbing agents may be singly added, or more than two of them may be combinedly added.

Additionally, such a liquid ultraviolet absorbing agent and another ultraviolet absorbing agent which is in the solid state at a normal temperature can be combinedly added.

The preferred solid untraviolet absorning agent for this purpose is 2-(2'-hydroxyphenyl)benzotriazole-type ultraviolet absorbing agent represented by Formula [I-S] which is in the solid state at an ordinary temperature, especially at 15 ° C.

Formula [I-S]

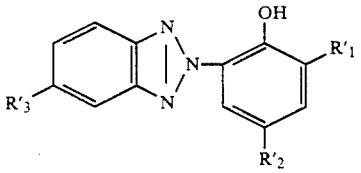

$R'_1$, $R'_2$ and $R'_3$ are each represent a hydrogen atom, halogen atom, alkyl group, aryl group, alkoxy group, arlyoxy group, alkenyl group, hydroxy group or nitro group.

When such a solid ultraviolet absorbing agent is used together with a liquid ultraviolet absorbing agent, the total weight of added ultraviolet absorbing agents can be reduced, because a solid type agent has a smaller molecular weight than a liquid type agent. Furthermore, by this arrangement, a certain weight of addition can more effectively improve the light-fastness of color dye image than other arrangement using the same weight of agent.

By using such a 2-(2'-hydroxyphenyl)benzotriazole-type ultraviolet absorbing agent, advantageous results are attained, because of its smaller diffusion within the layer it is added, and because it has an excellent compatibility with a liquid type ultraviolet absorbing agent.

The typical examples of such a solid 2-(2'-hydroxyphenyl) benzotriazole-type ultraviolet absorbing agent are as follows.

UV-1S

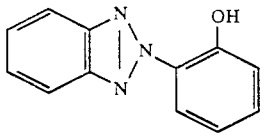

-continued

UV-2S

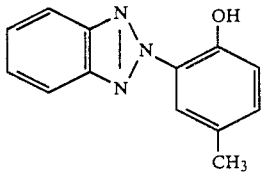

UV-3S

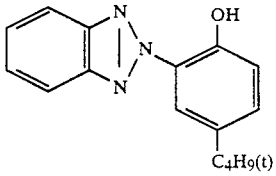

UV-4S

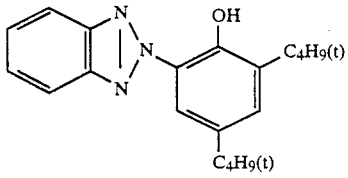

UV-5S

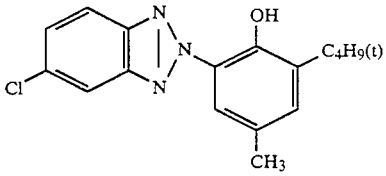

UV-6

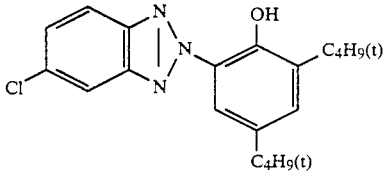

UV-7S

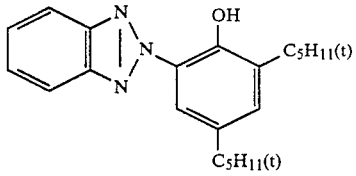

UV-8S

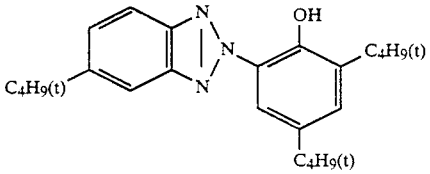

UV-9S

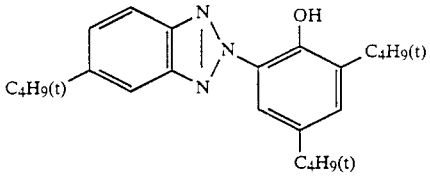

-continued

UV-10S

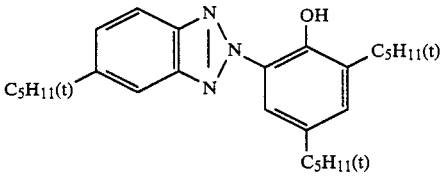

UV-11S

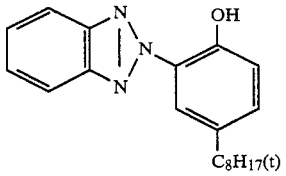

UV-12S

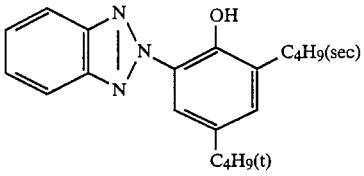

UV-13S

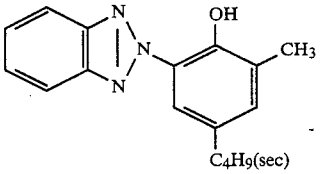

UV-14S

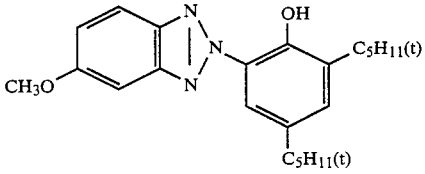

UV-15S

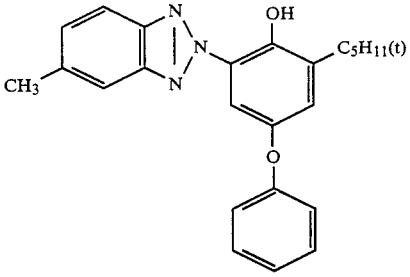

UV-16S

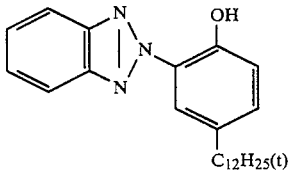

UV-17S

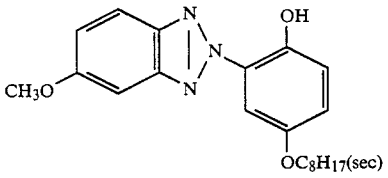

-continued

UV-18S

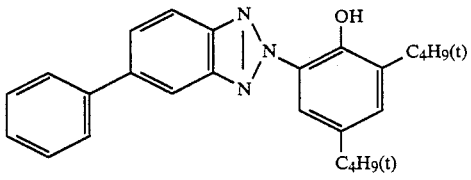

UV-19S

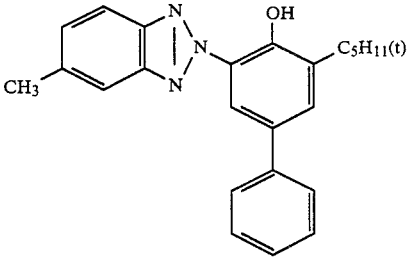

These benzotriazole compounds, either in the liquid or solid state, are disclosed in Japanese Patent Examined Publications No. 10466/1961, No. 26187/1967, No. 5496/1973 and No. 41572/1973, U.S. Pat. Nos. 3,754,919 and 4,220,711, Japanese Patent O.P.I. Publication No. 214152/1983, U.S. Pat. No. 4,518,686, International Patent Publication WO No. 81/01473, European Patent Bulletin (EP) No. 57,160, and others.

Any of these ultraviolet absorbing agents can be added into any photographic layer. When the similar absorbing agent is added into a non-light-sensitive layer, the preferred layer is a layer, when seen from the support side, located farther than a silver halide emulsion layer which is the nearest to the support. More favorably, the layer the agent is added into is a layer, when seen from the support side, located farther than a silver halide emulsion layer farthest from the support. If the agent is added into a silver halide emulsion layer, it is advantageous to add the agent into a silver halide layer located farthest from the support.

The addition of the liquid type ultraviolet absorbing agent of the invention may be arbitrarily selected as far as the amount of addition is appropriate for achieving the object of the invention. More specifically, the preferable amount is within the range of 0.01 to 5 g/m$^2$. Especially the range of 0.05 to 2 g/m$^2$ is advantageous.

When both liquid type and solid type ultraviolet absorbing agents, according to the invention, are simultaneously employed, the ratio of the liquid type to the solid type may be arbitrarily selected. However, the ratio is preferably within the range of 100:1 to 1:100. Especially, the range of 10:1 to 1:10 is advantageous.

The amount of hydrophilic binder used in a layer containing ultraviolet absorbing agent of the invention is preferably 0.01 to 3 g/m$^2$. The ratio of total amount of contained ultraviolet absorbing agent to hydrophilic binder is preferably within the range of 1:100 to 5:1. Especially, the range of 1:50 to 2:1 is advantageous.

The emulsification-dispersion of the ultraviolet absorbing agents relating to the invention may be prepared in the processes popularly applied to the photographic field of the art. They may be prepared in accordance with such a process of preparing coupler dispersions as described in, namely, U.S. Pat. Nos. 2,322,027, 2,801,170, 2,801,171, 2,870,012 or 2,991,177.

To be more concrete, an emulsification-dispersion may be prepared in such a manner that a compound relating to the invention is dissolved, if required, in a high boiling organic solvent having a boiling point of not lower than about 175 ° C. and a low boiling organic solvent having a boiling point of not higher than about 150° C. used in combination and the resultig solution is then finely dispersed in such a hydrophilic binder as an aqueous gelatin solution by making use of a surface active agent.

A more typical process for preparing the same may be referred to Japanese Patent O.P.I. Publication No. 215378/1984 and so forth, for example.

According to the invention, it is compulsory that at least one of ultraviolet absorbing agents being used is of a liquid type. This is because the improvement of anti-pressure properties, which is the object of the invention, cannot be achieved with a solid type ultraviolet absorbing agent only.

The silver halide photographic light-sensitive materials containing the above-mentioned silver halide emulsion of the invention (hereinafter, the silver halide photographic light-sensitive materials of the invention) can be, for example, those for color negative film, color positive film and color photographic paper, however, especially in the case of a color photographic paper, which is directly appreciated by human eyes, the effect of the method, according to the invention, is best demonstrated.

The silver halide photographic light-sensitive materials of the invention including the color photographic paper, above, can be either monochromatic or multi-colored. In principal, a multi-colored silver halide photographic light sensitive material has a constitution, in order to provide subtractive color reproduction, where silver halide emulsion layers containing magenta, yellow and cyan couplers serving as photographic couplers, as well as non-light sensitive layers are coated on a support in an adequate number and order. However, the number and order may be arbitrarily modified in compliance with a specific performance and utilization purposes.

If the silver halide photographic light-sensitive material of the invention is a multi-colored light-sensitive material, it can have an arbitrarily selected order in coating the silver halide emulsion layers, or more specifically, the blue-sensitive silver halide emulsion layer, green-sensitive silver halide emulsion layer and red-sensitive emulsion layer. Also, the order of non-lightsensitive layers, for example, an intermediate layer, filter layer, anti-irradiation layer and the like, other than a protective layer of the invention can be arbitrarily determined. However the typical preferred layer configuration comprises a support, sequentially provided thereon, a yellow-dye-image forming layer, first intermediate layer, magenta-dye-image forming layer, second intermediate layer containing ultraviolet absorbing agent, cyan-dye-image forming layer, intermediate layer containing ultraviolet absorbing agent, and protective layer.

As a yellow-dye forming coupler used in the invention, the known acylacetanilide couplers are fovorably used. Among these couplers, benzoylacetanilide and pyvaloylacetanilide compounds are especially advantageous. The typical examples of usable yellow couplers are those described in the following: British Patent No. 1,077,874, Japanese Patent Examined Publication No. 40757/1970, Japanese Patent O.P.I. Publications No. 1031/1972, No. 26133/1972, No. 94432/1973, No. 87650 1975, No. 3631/1976, No. 115219/1977, No. 433/1979, No. 133329/1979 and No. 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155, 4,401,725, and others.

The preferred yellow-dye forming couplers used in the invention are those expressed by the following formula [Y].

Formula [Y]

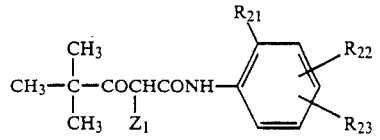

In the formula, $R_{21}$ represents a halogen atom or alkoxy group. $R_{21}$ represents a hydrogen atom, halogen atom, or an alkoxy group which may have a substituent. $R_{23}$ represents any of an acylamino group, alkoxycarbonyl group, alkylsulfamoyl group, arylsulfamoyl group, arylsulfonamide group, alkylureide group, arylureide group, succinimide group, alkoxy group and aryloxy group, each of which may have a substituent. $Z_1$ represents a group capable of being splitted off upon the reaction with the oxidized product of the color developing agent with the coupler.

According to the invention, as a magenta-dye-image forming coupler, the couplers represented either by the following formula [M-1] or [M-2] are favorably used.

Formula [M-1]

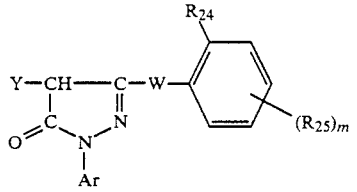

in the formula, Ar represents an aryl group. $R_{24}$ represents a hydrogen atom or substituent. $R_{25}$ represents a substituent. Y represents a hydrogen atom, or a substituent capable of being splitted off upon the reaction with the oxidized product of the color developing agent with the coupler. W represents any of —NH—, —NHCO— (an N atom is bonded with a carbon atom in the pyrazolone nucleus) and —NHCONH—. m represents an interger, one or two.)

In a magenta coupler represented by the formula [M-2]:

Formula [M-2]

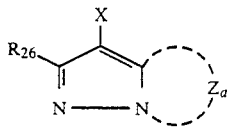

Za represents a group of nonmental atoms necessary to complete a heterocycle containing a nitrogen atom. The ring formed by Za may have a substituent.

X represents a hydrogen atom, or a substituent capable of being splitted off upon the reaction with the oxidized product of the color developing agent with the coupler.

$R_{26}$ represents either a hydrogen atom or a substituent. The examples of the substituent, represented by $R_{26}$, include a halogen atom, alkyl group, cycloalkyl group, alkenyl group, cycloalkenyl group, alkynyl group, aryl group, heterocyclic group, acyl group, sulfonyl group, sulfinyl group, phosphonyl group, carbamoyl group, sulfamoyl group, cyano group, residue of spiro compound, residue of bridged hydrocarbon compound, alkoxy group, aryloxy group, heterocyclic oxy group, siloxy group, acyloxy group, carbamoyloxy group, amino group, acylamino group, sulfonamido group, imido group, ureido group, sulfamoylamino group, alkoxycarbonylamino group, aryloxycarbonylamino group, alkoxycarbonyl group, aryloxycarbonyl group, alkylthio group, arylthio group, heterocyclic thio group and others.

These are described in the specifications and publications of the following patents: U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500; Japanese Patent O.P.I. Publications No. 29639/1974, No. 111631/1974, No. 129538/1974, No. 13041/1975, No. 58922/1977, No. 62454/1980, No. 118034/1980, No. 38043/1981, No. 35858/1982 and No. 23855/1985; British Patent No. 1,247,493; Belgium Patents No. 769, 116 and No. 792,525; West German Patent No. 2,156,111; Japanese Patent Examined Publication No. 60479/1971; Japanese Patent O.P.I. Publications No. 125732/1974, No. 228252/1974, No. 162548/1974, No. 171956/1974, No. 33552/1985 and No. 43659/1985; West German Patent No. 1,070,030; U.S. Pa. No. 3,725,067; and others.

According to the invention, as a cyan-dye-image forming coupler, the couplers represented either by the following formula [C-1] or [C-2] are favorably used.

Formula [C-1]

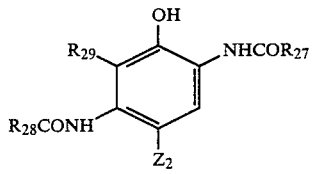

In this formula, $R_{27}$ represents an aryl group, cycloalkyl group or heterocyclic group. $R_{28}$ represents an alkyl group or phenyl group. $R_{29}$ represents a hydrogen atom, halogen atom, alkyl group or alkoxy group. $Z_2$ represents a hydrogen atom or halogen atom, or a group being capable of splitting off upon the reaction with the oxidized product of the aromatic primary amine color developing agent.

Formula [C-2]

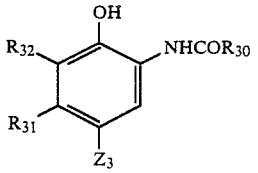

In this formula, $R_{30}$ represents an alkyl group such as a methyl group, ethyl group, propyl group, butyl group, nonyl group and the like. $R_{31}$ represents an alkyl group such as a methyl group, ethyl group and the like. $R_{32}$ represents a hydrogen atom, halogen atom such as fluorine, chlorine, bromine and the like or alkyl group such as a methyl group, ethyl group and the like. $Z_3$ represents a hydrogen atom or halogen atom, or a group capable of being splitted off upon the reaction with the oxidized product of the color developing agent with the coupler.

The typical cyan-dye-image forming couplers are four-equivalent or two-equivalent phenol-type and naphthol-type couplers, described in the specifications and publications of the following patents: U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476, 563, 3,737,316, 3,758,308 and No. 3,839,044; British Patents No. 478,991, No. 945,542, No. 1,084,480, No. 1,377,233, No. 1,388,024 and No. 1,543,040; Japanese Patent O.P.I. Publications No. 37425/1972, No. 10135/1975, No. 25228/1975, No. 112038/1975, No. 117422/1975, No. 130441/1975, No. 6551/1976, No. 37647/1976, No. 52828/1976, No. 108841/1976, No. 109630/1978, No. 48237/1979, No. 66129/1979, No. No. 117249/1985.

To disperse hydrophobic compounds such as dye-forming couplers and the like which are not necessarily adsorbed on the surface of silver halide crystals, various methods are applicable. These methods include the solid dispersion method, latex dispersion method, oil-in-water type emulsification dispersion method and others. A suitable method may be selected from these methods in compliance with a chemical structure, for example, of a hydrophobic compound such as a coupler. For the oil-in-water type emulsification dispersion method, the methods, known in the art, to disperse a hydrophobic compound such as a coupler may be applied, and, principally, a low-boiling point and/or water soluble organic solvent is used, in compliance with a specific requirement, together with a high-boiling organic solvent having a boiling point higher than 150 ° C., wherein the compound is solved, and the solution is emulsified and dispersed within a hydrophilic binder such as a gelatin solution, by means of an agitator, homogenizer, colloid mill, flow jet mixer, ultrasonic wave apparatus and the like, then, the emulsified dispersion is added into a hydrophilic colloid layer which needs the dispersion. It is further allowed to add a process for removing a low-boiling organic solvent from the dispersion or at the same time of dispersing.

As a high-boiling organic solvent, those which do not react with an oxidized product of a developing agent and have a boiling point greater than 150 ° C., such as a phenol derivative, alkyl phthalate, phosphorate, citrate, benzoate, alkylamide, aliphatic ester, trimesic ester and others are used.

The high-boiling organic solvents usable for the invention are those described in the following: U.S. Pat. Nos. 2,322,027, 2,533,514, 2,835,579, 3,287,134, 2,353,262, 2,852,382, 3,554,755, 3,676,137, 3,676,142, 3,700,454, 3,748,141, 3,779,765 and No. 3,837,863; British Patents No. 958,441 and No. 1,222,753; OLS Patent No. 2,538,889; Japanese Patent O.P.I. Publications No. 1031/1972, No. 90523/1974, No. 23823/1975, No. 26037 1976, No. 27921/1976, No. 27922/1976, No. 26035/1976, No. 26036/1976, No. 62632/1975, No. 1520/1978, No. 1521/1978, No. 15127/1978, No. 119921/1979, No. 119922/1979, No. 25075/1980, No. 36869/1980, No. 19049/1981 and No. 81836/1981; Japanese Patent Examined Publication No. 29060/1973; and others.

The low-boiling or water-soluble organic solvents usable together with or instead of the high-boiling solvents are those described in U.S. Pat. Nos. 2,801,171 and 2,949,360, and others. The low-boiling organic solvents which are substantially insoluble into water include an ethyl acetate, propyl acetate, butyl acetate, butanol, chloroform, carbon tetrachloride, nitromethane, nitroethane, benzene and the like. The water-soluble organic solvents include acetone, methylisobutylketone, β-ethoxyethyl acetate, methoxyglycol acetate, methanol, ethanol, acetonitrile, dioxane, dimethylformamide, dimethylsulfoxide, hexamethylphospholamide, diethyleneglycolmnophenyl ether, phenoxyethanol and the like.

As a latex dispersion method, the preferred methods are described in the following: U.S. Pat. Nos. 4,199,363, 4,214,047, 4,203,716 and 4,247,627; Japanese Patent O.P.I. Publications No. 74538/1974, No. 59942/1976, No. 59943/1976 and No. 32552/1979; and others.

The preferred surface active agents usable as dispersing aid are as follows: anion surface active agents such as alkylbenzene sulfonates, alkylnaphthalene sulfonates, alkyl sulfonates, alkyl sulfates, alkyl phosphates, sulfosuccinates, sulfoalkylpolyoxyethylene alkylphenyl ether and others; nonion surface active agents such as steroid saponins, alkylene oxide derivatives, glycidol derivatives and the like; amphoteric surface active agents such as amino acids, aminoalkylsulfonic acids, alkylabetaines and others; cation surface active agents such as quaternary ammonium salts and the like. The typical examples of these surface active agents are described in "Surface Active Agents Handbook" (Sangyoo Tosho, 1966) and "Research and Technical Data for Emulsifying Agent and Apparatus" (Kagaku Hanronsha, 1978).

It is advantageous to use gelatin as a binder or, a protective colloid of the silver halide emulsion of the invention. Other than this material, above, a gelatin derivative, graft polymer of gelatin and another high polymer, protein, sugar derivative, cellulose derivative, or a hydrophilic colloid derived from synthesized high polymer compound such as a homo- or copolymer can be also used.

To enhance the flexibility of the silver halide emulsion layers of light-sensitive material using the silver halide emulsion of the invention and/or other hydrophilic colloid layers, a plasticizer may be incorporated into these layers.

To improve the dimension stability and other properties, a dispersion or latex containing a synthesized polymer which is unsoluble or slightly soluble into water may be incorporated into the photographic emulsion layers and other hydrophilic colloid layers of light-sensitive material using the silver halide emulsion of the invention.

To prevent the oxidized product of developing agent or the electron-transfer agent from transferring to an emulsion layer from another between the layers having an indeitical color sensitivity and/or between the layers having different color sensitivities to each other, in the color photographic light-sensitive material of the invention, causing color contamination, deterioration in sharpness, and excessive graininess, an anti-color fogging agent may be used.

The anti-color fogging aent may be incorporated either into the emulsion layers themselves, or into intermediate layers provided between neighboring emulsion layers.

An image stabilizer to prevent the deterioration of dye-image may be incorporated into the light-sensitive material containing the silver halide emulsion of the invention.

A light-sensitive material containing the silver halide emulsion of the invention may be provided with auxiliary layers such as a filter layer, anti-hallation layer and/or anti-irradiation layer and ohters. These layers and/or emulsion layers may contain a dye which may either flow out of a color light-sensitive material or may be bleached during the development process.

In order to suppress a gloss of a light sensitive material, to improve retouchability, to prevent mutual adhesion of light-sensitive materials, a matting agent may be added into silver halide emulsion layers of the silver halide light-sensitive material using the silver halide light-sensitive emulsion of the invention and/or the other hydrophilic colloid layers.

To reduce sliding friction of the light-sensitive material using the silver halide emulsion of the invention, a lubricant may be incorporated.

In order to prevent electrification, an anti-static agent may be added into a light-sensitive material using the silver halide emulsion of the invention. The anti-static agent may be either added into an anti-static layer provided in one side of a support where no emulsion layers are provided, or into an emulsion layer and/or a protective layer which is not an emulsion layer and is provided in the other side of the support where emulsion layers are to be coated.

To improve the coating properties, to prevent electrification, to improve sliding properties, to enhance emulsification dispersion, to prevent mutual adhesion, and to improve photographic properties including acceleration of development, greater contrast, sensitization and others, various surface active agents are incorporated into the photographic emulsion layers of light-sensitive material using the silver halide emulsion of the invention and/or other hydrophilic colloid layers.

The photographic emulsion layers of light-sensitive material using the silver halide emulsion of the invention as well as other layers may be coated by coating upon a flexible reflecting support made of a paper or synthesized paper provided with a lamination of a baryta layer or β-olefin polymer and the like, or upon a film comprising a semisynthesized or synthesized high molecule such as a cellulose acetate, cellulose nitrate, polystyrene, polyvinyl chloride, polyethylene terephthalate, polycarbonate, polyamide and others, or upon a rigid body such as a glass, metal, ceramic and the like.

After the surface of support is subjected to corona charge, irradiation to ultraviolet-ray, flame treatment or the like, in accordance with a specific requirement, the silver halide material of the invention is coated upon the similar surface directly, or via a subbing layer, one or more subbling layer may be provided in order to improve, for the surface of support, the adhesion properties, anti-static properties, dimension stability, anti-abrasion properties, anti-hallation properties, friction properties and/or other properties.

When coating the photographic light-sensitive material containing the silver halide emulsion of the invention, a thickner may be used in order to improve the coating properties. As a coating method, either the extrusion coating or curtain coating, each being capable of simultaneously coating more than two layers, is especially advantageous.

The light sensitive material of the invention may be exposed with an electromagnetic wave having a spectral band to which the emulsion layers comprising the silver halide light sensitive material of the invention are sensitive. The known usable light sources are as follows: natural light (sunlight), tungsten incandescent lamp, fluorescent lamp, mercury arc lamp, xenon arc lamp, carbon arc lamp, xenon flash lamp, cathode ray tube flying spot, various lasers, various light emitting diodes, and light emitted from a fluorescent material excited by electron beam, X rays, $\gamma$ rays, $\alpha$ rays and the like.

As an exposure time, the duration ranges from one millisecond to one second, which is used for an ordinary camera. In addition, the exposure time with the duration less than one microsecond, 100 milliseconds—1 microsecond, for example, may be used by employing a cathode ray tube or xenon flash lamp. Furthermore, the exposure time may exceed one second. The exposure may be either continuously or intermittently carried out.

With the silver halide photographic light-sensitive material of the invention, the photographic image may be formed through the color development known in the art.

Color developing agents used in the color developer of the invention include the known agents widely used in various color photographic processes. Such developers contain aminophenol- or p-phenylenediamine-derivatives. These compounds are principally used in the form of a salt such as a hydrochloride or sulfate, because they are stabler in the salt state than in the free state. Additionally, the similar compounds are usually used at the rate of approx. 0.1 to 30 g, or more favorably approx. 1 to 15 g per liter color developer.

The examples of the aminophenol developers include an o-aminophenol, p-aminophenol, 5-amino-2-oxytoluene, 2-amino-3-oxytoluene, 2-oxy-3-amino-1,4-dimethylbenzene and others.

The especially useful aromatic primary amine color developers are N,N'-dialkyl-p-phenylenediamine compounds, whose alkyl group and phenyl group may independently have a substituent. The examples of the especially useful compounds include an N,N'-diethyl-p-phenylenediamine hydrochloride, N-methyl-p-phenylenediamine hydrochloride, N,N'-dimethyl-p-phenylenediamine hydrochloride, 2-amino-5-(N-ethylN-dodecylamino)-toluene, N-ethyl-N-$\beta$-methanesulfonamideethyl-3-methyl-4-aminaniline sulfate, N-ethyl-N-$\beta$-hydroxyethylaminaniline, 4-amino-3-methyl-N,N'diethylaniline, 4-amino-N-(2-methoxyethyl)-N-ethyl-3-methylaniline-p-toluenesulonate and others.

In addition to the above-mentioned aromatic primary amine color developer, any compound which is a component of the known developer may be added into the color developer used to treat the silver halide photographic light-sensitive material of the invention. The example of such a compound which is arbitraily incorporated into the color developer are as follows: alkali agents such as sodium hydroxide, sodium carbonate, pottasium carbonate and the like; sulfites of alkali metals, bisulfites of alkali metals, thiocyanates of alkali metals, halides of alkali metals, benzyl alcohol, water softener, thickener and others.

The pH values of the color developers are normally greater than 7, and usually, approx. 10 to 13.

The silver halide photographic light-sensitive materials of the invention is satisfactorily processed in the so-called rapid processes each capable of processing light-sensitive materials at a relatively high temperature and in a relatively short period of time. Such a color development is made at a temperature of not lower than 25° C. and, more preferably, within the range of from not lower than 30° C. to not higher than 45° C. A developing time is preferably within the range of from not shorter than 40 seconds to not longer than 120 second.

The silver halide photographic light-sensitive material, according to the invention, is allowed to contain any of these color developing agents within the hydrophilic layers as a color developing agent itself or as its precursor, each of which may be treated with an alkali activationbath. The precursors of color developing agents are the compounds being capable of making the color developing agents under alkali environments, and are exemplified by the following: Schiff's base-type precursor involving aromatic aldehyde derivative, multivalent metal ion complex precursor, imide phthalate derivative precursor, amide phosphate derivative precursor, precursor produced by reaction with sugar amine and urethane-type precursor. These precursors of aromatic primary amine color developing agents are described in the following patent specifications and literatures: U.S. Pat. Nos. 3,342,599, 2,507,114, 2,695,234 and No. 3,719,492; British Patent No. 803,783; Japanese Patent O.P.I. Pulications No. 185628/1978 and No. 79035/1979; Research Disclosure No. 15159, No. 12146 and No. 13924.

It is necessary to add these aromatic primary amine color developing agents or their precursors into the photographic light-sensitive material in the amount enough to cause the satisfactory color-formation through an activation treatment. Though such an amount varies in accordance with the type of light-sensitive material, it is generally 0.1 to 5 mol, or preferably 0.5 to 3 mol per mol silver halide. These color developing agents or their precursors may be either independently or combinedly used. When incorporate these agents or their precursors into the light-sensitive material, they may be added: after dissolved into an optional appropriate solvent such as water, methanol, ethanol, acetone and the like; or, in the form of emulsified dispersion using a high-boiling organic solvent such as dibutyl phthalate, dioctyl phthalate, tricresyl phosphate and the like; or, as described in Reasearch Disclosure No. 14850, after impregnated with latex polymer.

After color developing, the silver halide light-sensitive material of the invention is subjected to bleaching and fixing. The bleaching may be effected simultaneously with the fixing by a bleach-fixer. As a bleaching agent, various compounds are used. Among them, multivalent metal compounds involving iron (III), cobalt (III), copper (II) or the like are independently or combinedly used. More specifically, there multivalent metal compounds include complex salts of these multivalent metal cations and organic acids. These salts are as follows: metal complex salts derived from aminopolycarboxylic acids such as ethylenediaminetetraacetic acid, nitrilotriacetic acid, N-hydroxyethylethylenediaminediacetic acid and the like; the similar salt derived from malonic acid, tartaric acid, malic acid, diglycolic acid and the like. Also, ferricyanates, bichromates and others are used for this purpose.

As a fixer, a soluble complexing agent which solubilize silver halide as complex salt is used. The examples of such a soluble complexing agent include sodium thiosulfate, ammonium thiosulfate, potassium thiocyanate, thiourea, thioether and the like.

The above-mentioned bleach-fixer is used at a pH value of not less than 4.0, normally within the range of from not lower than pH 5.0 to not higher than 9.5, preferably, from not lower than pH 6.0 to not higher than pH 8.5 nd, most preferably, from not lower than pH 6.5 to not higher than 8.5. A temperature of such processing is not higher than 80° C. and preferably not higher than 55° C. or lower so as to inhibit an evaporation and so forth. A bleach fixing time is normally not longer than 120 seconds and, preferably, not longer than 60 seconds.

A color light-sensitive material already color-developed and bleach-fixed is necessarily washed so as to remove unnecessary chemicals. It is, however, allowd to replace the washing step by the so-called washless stabilization step such as those described in Japanese Patent O.P.I. Publication Nos. 14834/1983, 105145/1983 and 134634/1983, Japanese Patent Application Nos. 2709/1983 and 89288/1984, and so forth.

In the case of processing a color light-sensitive material while continuously replenishing each of the color developer, bleach-fixer and stabilizer of the invention, a suitable ratio of replenishing each replenisher is from 100 to 1000 ml per sq. meter of the color light-sensitive material and, more preferably, from 150 to 500 ml.

As can be understood from the description, above, the present invention can provide a silver halide phtotographic light-sensitive material, having excellent photographic properties, satisfying the two requirements, that is, the high developing speed and the great anti-pressure properties, and being suitable for rapid photographic processing.

EXAMPLES

The present invention is described more specifically with the reference to the following specific examples. However, the scope of embodiment of the invention is not limited only to these examples.

EXAMPLE- 1

Preparation of Silver Halide Emulsion EM-A (Silver Chloride)

Silver nitrate solution was added into inert gelatin water solution together with sodium chloride solution for 60 minutes by the double jet method. The temperature was kept at 50 ° C., and the pAg at 7.0.

Next, the desalting and water-washing were carried out according to a normal method, thus obtaining EM-A.

EM-A comprises cubic silver chloride grains having a mean grain diameter 0.8 μm.

Emulsion EM-B (Silver Chloro-bromide)

Water solution comprising silver nitrate solution, sodium chloride and potassium bromide was added into intert gelatin water solution by the double jet method. The temperature was kept at 60 ° C., and the pAg at 5.5.

Next, the desalting and water-washing were carried out according to a normal method, thus obtaining EM-B.

EM-B comprises cubic silver chloro-bromide grains (silver chloride content, 95 mol%) having a mean grain diameter 0.8μm.

EM-C, D, E and F were prepared in the same manner as EM-B, except that the silver chloride contents were respectively set at 90, 80, 50 and 20 mol%.

Sodium thiosulfate was added into each of the obtained EM-A through EM-F for sulfur senstization, then each was subjected to spectral sensitization by using sensitizing dye [SD-1]. Yellow coupler [YC-1] dissolved in dinonylphthalate was added into silver halide [EM-A] at the rate of 0.4 mol per mol silver halide. The mixture was coated on a polyethylene-coated paper so that the rate of coated silver was, when converted to metal silver, 0.4 g/m$^2$ and the rate of coated gelatin was 2.0 g/m$^2$. On this layer was provided, through coating, a protective layer containing gelatin at the rate of 3.0 g/m$^2$, ultraviolet absorbing agent, described in Table-1, at the rate of 1 g/m$^2$ and vinylsulfon hardener (V-19) at the rate of 0.1 g/m$^2$. This was designated sample 1. In addition, samples 2 through 18 were prepared by incorporating modification as shown in Table-1.

Ultraviolet absorbing agent-emulsified dispersion was prepared in the following manner.

(a) Ten g ultraviolet absorbing agent having the composition shown in Table-1, ten g dinonyl phthalate and 20 g ethyl acetate were mixed, and dissolved by heating them to approximately 60 ° C.

(b) Fifteen g photographic gelatin and 200 ml pure water were mixed at a room temperature, then gelatin was allowed to swell for 20 minutes. The mixture was heated to approximately 60 ° C. to dissolve gelatin, then 20 ml of 5 % alkanol B (manufactured by DuPont) water solution was added, and the mixture was agitated to make the homogeneous solution.

(c) The two solutions prepared respectively through the steps (a) and (b) were mixed, and subjected to dispersion for 20 minutes by an ultrasonic dispersing apparatus, in order to prepare emulsified dispersion. The dispersion was poured into 300 ml pure water to prepare the required dispersion.

Each of the samples prepared in the manner, described above, was subjected to exposing with optical wedge by using a sensitometer, model KS-7 (manufactured by Konishiroku Photo Industry Co., Ltd.), then treated and tested in the following manner.

TABLE 1

| Sample No. | Silver handle emulsion EM | AgCl Mol % | Harder | Ultraviolet absorbing agent | |
|---|---|---|---|---|---|
| 1 | A | 100 | V-19 | UV-15L | Invention |
| 2 | B | 95 | V-19 | UV-15L | Invention |
| 3 | C | 90 | V-19 | UV-15L | Invention |
| 4 | D | 80 | V-19 | UV-15L | Invention |
| 5 | E | 50 | V-19 | UV-15L | Comparison |
| 6 | F | 20 | V-19 | UV-15L | Comparison |
| 7 | A | 100 | Comparison hardener-1 | UV-15L | Comparison |
| 8 | C | 90 | Comparison hardener-1 | UV-15L | Comparison |
| 9 | E | 50 | Comparison hardener-1 | UV-15L | Comparison |
| 10 | A | 100 | V-2 | — | Comparison |
| 11 | C | 90 | V-2 | — | Comparison |
| 12 | E | 50 | V-2 | — | Comparison |
| 13 | A | 100 | V-2 | UV-7S:UV-4S = 1:1 | Comparison |
| 14 | C | 90 | V-2 | UV-7S:UV-4S = 1:1 | Comparison |
| 15 | E | 50 | V-2 | UV-7S:UV-4S = 1:1 | Comparison |
| 16 | A | 100 | V-2 | UV-7S:UV-15L = 1:1 | Invention |
| 17 | C | 90 | V-2 | UV-7S:UV-15L = 1:1 | Invention |
| 18 | E | 50 | V-2 | UV-7S:UV-15L = 1:1 | Comparison |

(YC-1)

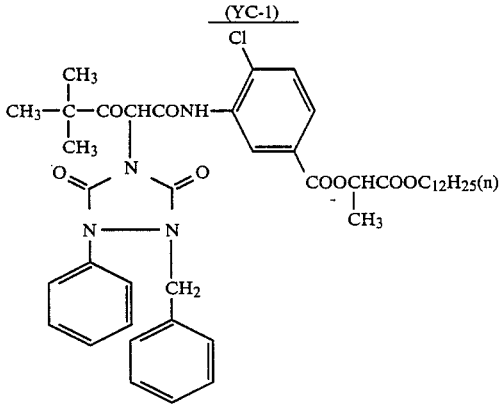

(Comparison hardener-1)

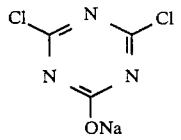

(Sensitizing dye) SD-1

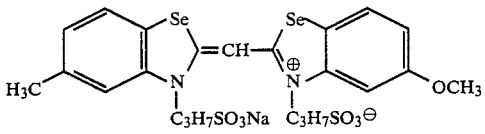

| (Processing steps) | Temperature | Time |
|---|---|---|
| Color developing | 34.7 ± 0.3° C. | 50 sec. |
| Bleach-fixing | 34.7 ± 0.5° C. | 50 sec. |
| Stabilizing | 30–34° C. | 90 sec. |
| Drying | 60–80° C. | 60 sec. |

(Color developer)

| | |
|---|---|
| Pure water | 800 ml |
| Ethylene glycol | 10 ml |
| N,N-diethylhydroxylamine | 10 g |
| Potassium chloride | 2 g |
| N-ethyl-N-β-methanesulfomamideethyl-3-methyl-4-aminoaniline sulfate | 5 g |
| Sodium tetrapolyphosphate | 2 g |
| Potassium carbonate | 30 g |
| Fluorescent brightener (4,4'-diaminostylbendisulfonic derivative) | 1 g |

Water was added to make one liter solution, which was arranged to have the pH of 10.08.

(Bleach-fixer)

| | |
|---|---|
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |

Potassium carbonate or glacial acetic acid was added so as to attain the pH value of 7.1, wherein water was added in order to prepare one liter solution.

(Stabilizing solution)

| | |
|---|---|
| 5-chloro-2-methyl-4-isothiazoline-3-one | 1 g |
| 1-hydroxyethylidene-1,1-diphosphonic | 2 g. |

Water was added to make one liter solution, which was arranged with sulfuric acid or potassium hydroxide to have the pH value of 7.0.

Sensitometric Properties

With each of the samples, already exposed and treated as mentioned previously, gamma (γ) and maximum reflection density was measured by a photoelectric densitometer (model PDA-60, manufactured by Konishiroku Photo Industry Co., Ltd.). The measurements obtained are shown in Table-2.

Anti-pressure Properties

(1) Anti-pressure properties in dry state

Before the exposure, the emulsion surface of each samples was scratched with the loads, 5, 10, 20, 30 and 50 g, by using a Heydon scratch hardeness tester, Model 18 (manufactured by Shinto Kagaku Co., Ltd.). Then, each was exposed and treated in the manner identical to the sensitometry described earlier, in order to evaluate each sample by using loads (in g) needed to cause sensitization or desensitization (sensitization being denoted by "+", desensitization by "−"). Needless to say, a larger value means that the corresponding sample is more advantageous.

(2) Anti-pressure Properties in Moist State

After the exposure, each sample was dipped in 33 ° C. pure water, then scratched with the same conditions as (1). After dried, each sample was treated and evaluated in the same manner as (1).

The results obtained from (1) and (2) are shown in Table-2.

TABLE 2

| Sample No. | Sensitometry γ | Sensitometry Maximum reflection desnity | Anti-pressure properties Dry | Anti-pressure properties Moist | |
|---|---|---|---|---|---|
| 1 | 3.40 | 2.55 | −30 | +20 | Invention |
| 2 | 3.41 | 2.55 | −30 | +20 | Invention |
| 3 | 3.40 | 2.56 | −30 | +20 | Invention |
| 4 | 3.39 | 2.54 | −30 | +20 | Invention |
| 5 | 3.03 | 2.01 | −20 | +10 | Comparison |
| 6 | 2.51 | 1.75 | −20 | +10 | Comparison |
| 7 | 3.40 | 2.55 | −5 | +5 | Comparison |
| 8 | 3.39 | 2.54 | −10 | +5 | Comparison |
| 9 | 3.00 | 2.02 | −10 | +5 | Comparison |
| 10 | 3.39 | 2.52 | −10 | +5 | Comparison |
| 11 | 3.38 | 2.50 | −20 | +10 | Comparison |
| 12 | 3.02 | 1.97 | −20 | +10 | Comparison |
| 13 | 3.42 | 2.54 | −10 | +5 | Comparison |
| 14 | 3.40 | 2.55 | −20 | +5 | Comparison |
| 15 | 3.01 | 2.00 | −20 | +10 | Comparison |
| 16 | 3.42 | 2.56 | −30 | +20 | Invention |
| 17 | 3.41 | 2.55 | −30 | +20 | Invention |
| 18 | 3.03 | 2.04 | −20 | +10 | Comparison |

According to the results in Table-2, when comparing the sensitometric properties of the samples, respectively, 1 through 6, 7 through 9, 10 through 12, 13, through 15 and 16 through 18, it is apparent that the samples having greater silver chloride contents have better sensitometric properties. In terms of the anti-pressure properties of the samples 7 through 9 and 10 through 12, it is apparent that the samples 7, 8, 10 and 11 having the greater silver chloride contents have the similar properties poorer than that of the samples 9 and 12.

At the same time, when comparing the sample 6 with the sample 9, the sample 6 having incorporated vinylsulfon hardener rather than the comparison hardener-1 showed better properties, however, the degree of improvement in properties are still insufficient for practical application.

When compared to the samples with no ultraviolet absorbing agent incorporated, the samples 5 and 6 containing liquid ultraviolet absorbing agent in their protective layers showed no improvement. In contrast, the samples 1 and 10 containing emulsions respectively having the greater silver chloride content, when compared to the samples 10 and 11, showed significantly improved anti-pressure properties. This can be called an unexpectedly remarkable effect which cannot be expected from the results of conventional methods.

The samples 13 through 15, containing solid ultraviolet absoring agent respectively in their protective layer failed to provide the effect for the similar improvement.

EXAMPLE-2

A sample having the layer structure in Table-3 was prepared.

TABLE 3

| Layer No. | Nature of layer | Polyethylene-coated paper: Rate of coated silver | Rate of coated gelatin | Rate of coated ultraviolet absorbing agent (below) | Rate of coated coupler | High-boiling organic solvent |
|---|---|---|---|---|---|---|
| Layer 7 | Protective layer | — | 7 | — | — | — |
| Layer 6 | Third intermediate layer | — | 10 | 4.0 | — | DOP 3.0 |
| Layer 5 | Red-sensitive emulsion layer | 3.0 | 15 | — | Cyan coupler, below 6.0 | DOP 3.0 |
| Layer 4 | Second intermediate layer | — | 15 | 8.0 | — | DOP 6.0 |
| Layer 3 | Green-sensitive emulsion layer | 3.0 | 15 | — | Magenta coupler, below 6.1 | TCP 5.0 |
| Layer 2 | First intermediate layer | — | 7 | — | — | DOP 0.5 |
| Layer 1 | Blue-sensitive emulsion layer | 4.0 | 15 | — | Yellow coupler, above 10.0 | DBP 6.0 |

*In this table, TCP denotes tricresylphosphate.
*In this table, DOP and DBP respectively denote di-t-ethylhexyl phthalate and dibutyl phthalate.
*The rate of coating is in mg/100 cm².

(Magenta coupler)

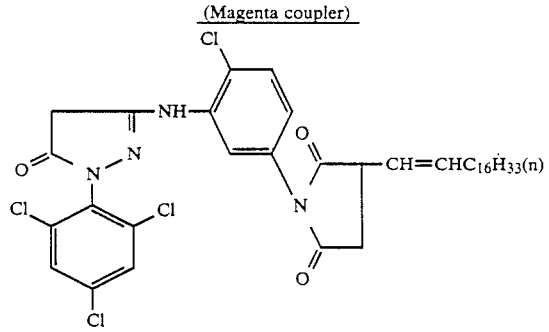

The two types cyan couplers, below, were used at the proportion, in terms of weight, of 1:1.

(Cyan coupler)

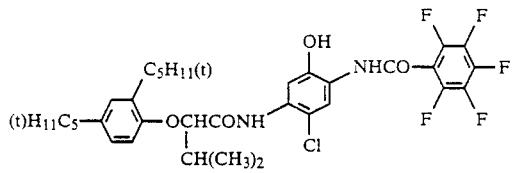

-continued
(Cyan coupler)

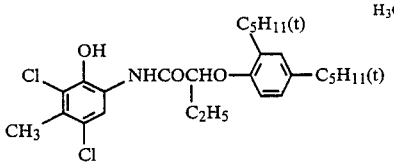

of ultraviolet absorbing agents as well as the layers into which the agents were added.

TABLE 4

| | Silver halide emulsion (EM) | | | Ultraviolet absorbing agent | | Hardener (mg/100 cm$^2$) | | |
|---|---|---|---|---|---|---|---|---|
| | Layer 1 | Layer 3 | Layer 5 | Layer 4 | Layer 6 | Layer 4 | Layer 7 | |
| 21 | F | G | H | UV-4S:UV-12S :UV-6S = 2:2:1 | UV-4S:UV-12S :UV-6S = 2:2:1 | V-19 1.0 | V-19 1.0 | Comparison |
| 22 | A | G | H | UV-4S:UV-12S :UV-6S = 2:2:1 | UV-4S:UV-12S :UV-6S = 2:2:1 | V-19 1.0 | V-19 1.0 | Comparison |
| 23 | A | G | H | UV-8L | UV-8L | V-19 1.0 | V-19 1.0 | Invention |
| 24 | A | I | J | UV-13L | UV-13L | V-19 1.0 | V-19 1.0 | Invention |
| 25 | A | I | J | UV-15L | UV-15L | V-3 1.0 | V-3 1.0 | Invention |
| 26 | A | I | J | UV-7S | UV-15L | V-2 1.0 | Comparison hardener-1 1.0 | Invention |
| 27 | A | I | J | UV-7S:UV-4S :UV-8L = 1:1:2 | UV-7S:UV-15L = 1:1 | V-19 1.0 | Comparison hardener-1 1.0 | Invention |

The silver halide emulsions A, F, G, H, I and J were prepared in the same manner as Example-1. They are listed below.

| | Mean particle diameter (μm) | Silver chloride ratio (mol %) | Spectral sensitizing dye |
|---|---|---|---|
| EM-A | 0.8 | 100 | SD-1 |
| EM-F | 0.8 | 20 | SD-1 |
| EM-G | 0.4 | 20 | SD-2 |
| EM-H | 0.4 | 20 | SD-3 |
| EM-I | 0.4 | 100 | SD-2 |
| EM-J | 0.4 | 100 | SD-3 |

Spectral sensitizing dye
SD-2

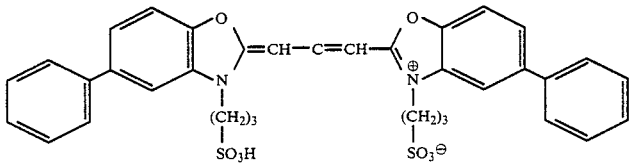

SD-3

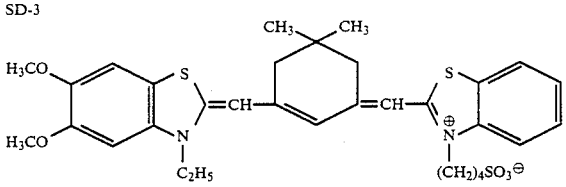

The samples prepared in the above manner were tested in the same manner as Example-1. The results are shown in Table-5.

TABLE 5

| Sample No. | Sensimetry Y γ | Sensimetry Y Dm | Sensimetry M γ | Sensimetry M Dm | Sensimetry C γ | Sensimetry C Dm | Anti-pressure properties Y Dry | Anti-pressure properties Y Moist | Anti-pressure properties M Dry | Anti-pressure properties M Moist | Anti-pressure properties C Dry | Anti-pressure properties C Moist | |
|---|---|---|---|---|---|---|---|---|---|---|---|---|---|
| 21 | 2.61 | 2.02 | 3.23 | 2.60 | 3.62 | 2.63 | −20 | +10 | −30 | — | −20 | — | Comparison |
| 22 | 3.66 | 2.74 | 3.22 | 2.62 | 3.62 | 2.64 | −10 | +5 | −20 | — | −10 | — | Comparison |
| 23 | 3.68 | 2.76 | 3.23 | 2.65 | 3.61 | 2.65 | −30 | +20 | −50 | — | −30 | — | Invention |
| 24 | 3.74 | 2.79 | 3.60 | 2.70 | 3.73 | 2.65 | −30 | +20 | −50 | — | −30 | — | Invention |
| 25 | 3.72 | 2.78 | 3.61 | 2.70 | 3.73 | 2.65 | −30 | +20 | −50 | — | −30 | — | Invention |
| 26 | 3.72 | 2.78 | 3.60 | 2.69 | 3.75 | 2.66 | −30 | +20 | −50 | — | −30 | — | Invention |
| 27 | 3.74 | 2.78 | 3.62 | 2.70 | 3.74 | 2.65 | −30 | +20 | −50 | — | −30 | — | Invention |

*In this table, Dm means maximum reflecting density.
"—" in anti-pressure properties column shows that there was no pressure effect found even with a 50 g load.

Samples 21 through 27 were prepared, as shown in Table-4, by replacing the types of silver halide emulsion contained in layers 1, 3 and 5, by incorporating a hardener into each fourth layer, and by modifying the types The results in Table-5 demonstrate that the effect for improvement comparable to that of Example-1 was found on the multi-layered silver halide color photographic light-sensitive materials, and that the light-sensitive materials suitable for the rapid processing were realized.

Furthermore, when compared to comparison samples 1 and 2, light-sensitive material samples (23 through 27) of the invention had the excellent gloss when dried in a lower temperature after the rapid processing.

What is claimed is:

1. A silver halide photographic light-sensitive material comprising a support provided thereon with photographic layers including at least one silver halide emulsion layer and at least one non-light-sensitive layer, wherein said silver halide emulsion layer comprises silver halide grains having at least 80 mol % of silver chloride, and at least one layer of said photographic layers contains, as an ultra-violet absorbing agent, 2-(2-hydroxy phenyl) benztriazole derivative of the formula

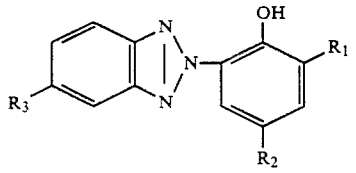

2. The material of claim 1 wherein said vinylsulfone hardener is of Formula [V-I]

$$B\text{-}[(A)m\text{—}(D)l\text{—}SO_2\text{—}CH{=}CH_2]n$$

wherein B is an organic group, A is a divalent linking group, D is an alkylene group, an arylene group or an alkenylene group, n is an integer 2 to 6, m is 0 or 1, and l is 0 or 1, when n is 2, B is allowed to be a simple link.

3. The material of claim 1 wherein said silver halide emulsion layer comprises silver halide grains having at least 90 mol % of silver chloride.

4. The material of claim 1 wherein at least one layer of said photographic layers is hardened with said vinylsulfone hardener in an amount of 0.5 to 100 mg per g of gelatin contained in said photographic layers.

5. The material of claim 4 wherein at least one layer of said photographic layers is hardened with said vinylsulfone hardener in an amount of 2.0 to 50 mg per g of gelation contained in said photographic layers.

6. The material of claim 1 wherein said ultra-violet absorbing agent is represented by Formulas [II], [III], [IV] or [V]:

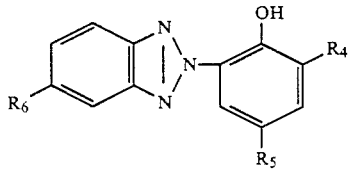

Formula [II]

wherein $R_4$ is a methyl group, an ethyl group or a propyl group, $R_5$ is a secondary alkyl group having at least four carbon atoms, and $R_6$ is hydrogen, halogen, or an alkyl or alkoxy group having one to eight carbon atoms;

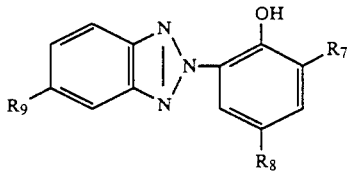

Formula [III]

wherein $R_7$, $R_8$ and $R_9$ are each an alkyl group having at least four or more carbon atoms provided that at least one of said alkyl groups represented by $R_7$, $R_8$ and $R_9$ is a secondary alkyl group;

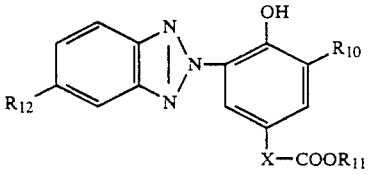

Formula [IV]

wherein $R_{10}$ is an alkyl group having one to eight carbon atoms, X is an alkylene group having one to six carbon atoms, $R_{11}$ is an alkyl group having one to twelve carbon atoms, and $R_{12}$ is the same group as $R_6$ of Formula [II];

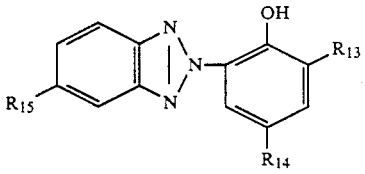

Formula [V]

wherein $R_{13}$ and $R_{14}$ are each a secondary alkyl group having at least four carbon atoms and $R_{15}$ is the same group as $R_6$ of Formula (II).

7. The material of claim 1 wherein at least one layer of said photographic layers contains said ultra-violet absorbing agent in an amount of 0.01 to 5 g per $m^2$ of said layer.

8. The material of claim 7 wherein at least one layer of said photographic layers contains said ultra-violet absorbing agent in an amount of 0.05 to 2 g per $m^2$ of said layer.

9. The material of claim 1 wherein at least one layer of said photographic layers contains an ultra-violet absorber which is solid at room temperature together with said ultra-violet absorbing agent.

10. The material of claim 9 wherein said ultraviolet absorber is of the Formula [I-S]:

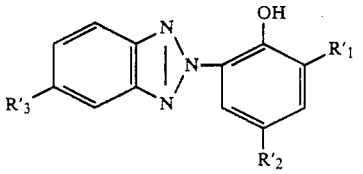

Formula [I-S]

$R_{1'}$, $R_{2'}$ and $R_{3'}$ are each a hydrogen atom, a halogen atom, an alkyl group, and aryl group, an alkoxy group, an aryloxy group, an alkenyl group, a nitro group or a hydroxy group.

11. The material of claim 1 wherein said ultra-violet absorbing agent is in said non-light-sensitive layer.

12. The material of claim 1 wherein said photographic layers include at least one first silver halide emulsion layer containing a yellow dye-forming coupler, at least one second silver halide emulsion layer containing a magenta dye-forming coupler, and at least one third silver halide emulsion layer containing a cyan dye-forming layer.

* * * * *